US006284062B1

(12) United States Patent
Nagashima et al.

(10) Patent No.: US 6,284,062 B1
(45) Date of Patent: Sep. 4, 2001

(54) MEMBER FOR IMMERSION IN HOT DIP GALVANIZING BATH AND METHOD FOR PRODUCING THE SAME

(75) Inventors: Takeo Nagashima; Eizo Sakuma; Katsuaki Takano, all of Funabashi (JP)

(73) Assignee: Taiyo Steel Co., Ltd., Tokyo (JP)

( * ) Notice: Subject to any disclaimer, the term of this patent is extended or adjusted under 35 U.S.C. 154(b) by 0 days.

(21) Appl. No.: 09/321,555

(22) Filed: May 28, 1999

Related U.S. Application Data

(62) Division of application No. 09/035,761, filed on Mar. 6, 1998.

(30) Foreign Application Priority Data

Mar. 27, 1997 (JP) ..... 9-91363

(51) Int. Cl.[7] ..... C23C 8/26; C23C 8/50

(52) U.S. Cl. ..... 148/318; 148/906; 148/230; 148/231; 148/232; 266/120

(58) Field of Search ..... 148/230, 231, 148/232, 533, 906, 318; 266/120

(56) References Cited

U.S. PATENT DOCUMENTS

| | | | | |
|---|---|---|---|---|
| 5,053,112 | | 10/1991 | Jones et al. . | |
| 5,312,531 | | 5/1994 | Nishimura et al. . | |
| 5,391,135 | | 2/1995 | Kuroki et al. . | |
| 5,399,211 | | 3/1995 | Yoshino et al. . | |
| 5,873,956 | * | 2/1999 | Tanaka et al. | 148/906 |

FOREIGN PATENT DOCUMENTS 2284824 6/1995 (GB) .

* cited by examiner

*Primary Examiner*—Deborah Yee
(74) *Attorney, Agent, or Firm*—Wenderoth, Lind & Ponack, L.L.P.

(57) ABSTRACT

A member used in contact with a hot dip galvanizing bath, such as a sinker roll, a support roll or a bearing, is produced by nitriding stainless steel to form a nitride layer and a nitrogen-diffused layer on the surface thereof. The member used in contact with a hot dip galvanizing bath is formed on its surface with the nitride layer by nitriding it in a salt bath containing a cyanide, a cyanate, a carbonate and the like or by heat-treating it in an atmosphere containing ammonium or nitrogen.

4 Claims, 1 Drawing Sheet

MEMBER FOR IMMERSION IN HOT DIP GALVANIZING BATH AND METHOD FOR PRODUCING THE SAME

This is a divisional of Ser. No. 09/035,761, filed Mar. 6, 1998, now pending.

BACKGROUND OF THE INVENTION

1. Field of the Invention

This invention relates to a member of a hot dip galvanizing line used in contact with a hot dip galvanizing bath in the process of producing hot dip galvanized steel sheet and to a process for producing the member.

2. Description of the Background Art

In a production line for plating the surface of steel sheet with zinc or zinc alloy by reduction-treating cold-rolled steel sheet in a heat-treatment furnace and then immersing it in a hot dip galvanizing bath, the practice has been to fabricate the members of the hot dip galvanizing line making contact with the hot dip galvanizing bath of iron or ceramic, or of stainless steel or other metal. Among these materials, ceramic is excellent in erosion resistance but is brittle, while metallic materials such iron and stainless steel are excellent in strength and other mechanical properties but are readily eroded by the hot dip galvanizing bath.

This is a particular problem in the case of the sinker roll that supports the steel sheet in the hot dip galvanizing bath and alternately changes its direction of travel between downward and upward as it passes through the bath. The wear and erosion these rolls incur in turn degrades the quality of the hot dip galvanized steel sheet, most notably its surface properties.

Methods for preventing this include that of flame spraying the surface of the sinker roll with a coating of either a self-fluxing alloy containing nickel, cobalt and other metals or tungsten carbide containing cobalt, that of flame spraying them with a coating of an oxide-type ceramic with extremely low wettability, and that of flame spraying them with a film of silicon nitride or Sialon (Japanese Patent Application Laid-open Nos. 4-254571 and 6-228724).

These prior art technologies are not entirely satisfactory, however, owing to the following problems.

The self-fluxing alloy containing cobalt, nickel etc., the tungsten carbide containing cobalt, and other such coatings are degraded by reactions with the zinc in the hot dip galvanizing bath. Since the cobalt and nickel are present in the coating in metallic state, they drop out upon forming alloys with the zinc, leading to eventual disintegration of the coating itself.

Since the coating obtained by flame spraying a ceramic such as oxide or silicon nitride contains many bubbles and cracks, it is low in coating strength and soon peels off. Since the adhesive strength between the flame-sprayed coating and the base metal is weak, moreover, this coating has a number of drawbacks, including poor wear resistance and weak thermal shock resistance.

It is also expensive owing to the complex fabrication process which involves additional nitriding of the coating after flame spraying.

The object of the invention is to overcome the foregoing problems.

SUMMARY OF THE INVENTION

The invention achieves this object by providing:

(1) A member for immersion in a hot dip galvanizing bath such as a sinker roll, a support roll, a bearing or the like comprising stainless steel (which incurs little fusing loss in the hot dip galvanizing bath) as base metal and on the surface of the stainless steel a layer of nitrides of elements composing the stainless steel and a nitrogen-diffused layer.

(2) A process for producing a member for immersion in a hot dip galvanizing bath comprising a step of fabricating a member for immersion in a hot dip galvanizing bath such as a sinker roll, a support roll, a bearing or the like of stainless steel as base metal and a step of forming a nitride layer and a nitrogen-diffused layer on the surface of the member by nitriding it in a salt bath containing a cyanide, a cyanate, a carbonate and the like or by heat-treating it in an atmosphere containing ammonium or nitrogen.

(3) A member for immersion in a hot dip galvanizing bath according to (1) above which is used in a hot dip galvanizing bath whose Al content is not less than 0.1 wt % and not greater than 70 wt %.

(4) A member for immersion in a hot dip galvanizing bath according to (1) above, wherein the stainless steel is SUS316 or SUS316L.

(5) A process for producing a member for immersion in a hot dip galvanizing bath according to (2) above, wherein the stainless steel is SUS316 or SUS316L.

The term "member for immersion in a hot dip galvanizing bath" as used regarding the invention is defined to encompass any member (including a component, a vessel or the like) that makes contact with a hot dip galvanizing bath including, but not limited to, a sinker roll, a support roll, a bearing, a galvanizing tank and a snout. The term "hot dip galvanizing bath" as used regarding the invention is defined to encompass any galvanizing bath consisting mainly of molten zinc but also including Al, Si, Mg and the like plus unavoidable impurities such as a small amount of iron.

DETAILED DESCRIPTION OF THE PREFERRED EMBODIMENTS

Figure 1:
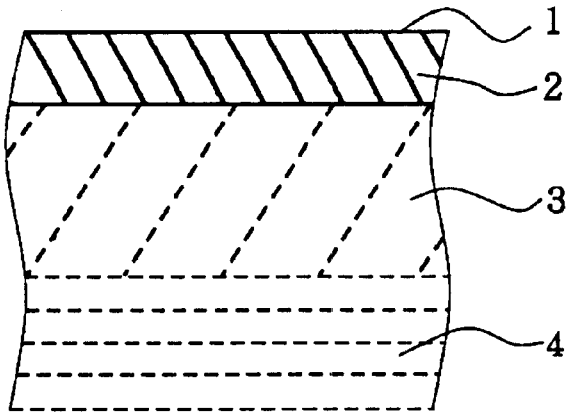
FIG. 1 is a sectional view showing an enlarged depthwise section of the surface portion of a member according to the invention.

The diagram of FIG. 1 shows an enlarged depthwise section of the surface portion of a member according to the invention taken in the depth direction. The member comprises an outermost surface 1, a nitride layer 2 immediately under the outermost surface 1, a nitrogen-diffused layer 3 under the nitride layer 2 and a base metal 4 under the nitrogen-diffused layer 3. The base metal 4 is stainless steel.

The nitride layer 2 is composed of nitrides of components of the stainless steel, specifically nitrides of Cr, Ni, Fe etc. The nitrogen-diffused layer 3 is a portion where nitrogen diffused into the stainless steel base metal 4 is present partly in the form of precipitates and partly in the form of solid solution.

The nitride layer 2 has extremely low wettability to a hot dip galvanizing bath and is safe from peeling and separation, because the nitride layer does not form an alloy layer with the zinc in the bath. Moreover, the nitrogen in the nitride layer 2 or the nitrogen-diffused layer 3 reacts with Al in the hot dip galvanizing bath, as indicated below, to form Al nitride (AlN) at the outermost surface 1. As is generally true of nitrides, this AlN also exhibits very low wettability to the hot dip galvanizing bath and does not peel off since AlN does not form an alloy layer with the zinc in the bath.

$$Al+N \rightarrow AlN \qquad \text{Eq. 1}$$

Al is present in the hot dip galvanizing bath in metallic form. On the other hand, nitrogen that can move freely within the nitrogen-diffused layer is present in the member. When nitrogen in the member migrates to the surface and meets Al in the hot dip galvanizing bath, AlN is formed on the surface. Since this AlN does not dissolve into the hot dip galvanizing bath or the member it constitutes a surface protection layer.

The most salient feature of this invention is the self-repairing capability of the nitride layer (the nitride layer 2 in FIG. 1). Even in the unlikely event that the initially formed nitride layer 2 breaks and peels off, an AlN protection layer forms in its place. Owing to the manner in which the coating constituted by the AlN protection layer is formed, moreover, it is tightly bound to the base metal.

Specifically, when the nitrogen from the base metal (the nitrogen-diffused layer 3 in FIG. 1) reaches the base metal surface (interface), it reacts with the Al in the hot dip galvanizing bath to form AlN. Since this AlN forms a coating along the microscopic irregularities of the base material, its adherence is excellent.

The nitride layer is thin (about 1–50 $\mu$m thick) and exhibits excellent adherence and strong resistance to thermal shock since it is formed at the surface of stainless steel constituting the base metal. Therefore, unlike a flame-sprayed member, the member according to the invention requires no preheating or any other treatment whatsoever prior to immersion in the hot dip galvanizing bath.

The hot dip galvanizing bath referred to herein invariably contains (1) pure Zn or (2) Zn plus one or more of Al, Mg, Si, Pb and Sb. The hot dip galvanizing bath also of course contains Fe, Mn and other impurity components that enter it from the steel sheet and other sources.

Known hot dip galvanizing bath compositions include, for example, (1) a composition consisting of about 0.2 wt % of Pb, 0.1–0.2 wt % of Al and the balance of Zn and unavoidable impurities, (2) a composition consisting of 0.1–0.3 wt % of Al, small amounts of Sb and Mg and the balance of Zn and unavoidable impurities, (3) a composition consisting of 4–5 wt % of Al, small amounts of Sb and Mg and the balance of Zn and unavoidable impurities, and (4) a composition consisting of 55 wt % of Al, 1.6 wt % of Si and the balance of Zn and unavoidable impurities. While the bath of composition (4) is called a zinc-aluminum alloy bath, it is treated as a hot dip galvanizing bath by this invention. The invention is not limited to the hot dip galvanizing baths (1)–(4), which are cited here only by way of example.

The Al content of the hot dip galvanizing bath is specified as not less than 0.1 wt % in order to secure the Al required for formation of AlN. It was found that when the Al content of the hot dip galvanizing bath is less than 0.1 wt %, the self-repair capability is insufficient.

Even when the Al content of the hot dip galvanizing bath is less than 0.1%, the nitrided member exhibits good erosion resistance. When breakage of the nitride layer occurs, however, the self-repair capability is inadequate. From the point of the invention principle of forming stable Al nitride (AlN: ceramic) by the meeting of Al and nitrogen, the invention can exhibit its effect even at an Al content of 100% (hot Al plating bath). Since Al has a high melting point of 660° C., however, such a high Al content would cause problems such as thermal deformation of the base metal and annihilation of the nitrogen-diffused layer (reduction of the nitrogen content of the nitrogen-diffused layer to a low level owing to thermal diffusion of its nitrogen into the interior of the base metal). Even in the case of a Zn—Al alloy galvanizing bath, therefore, the upper limit of the Al content is specified as 70 wt %.

Various types of metal sheets were immersed in a 600° C. hot dip galvanizing bath containing 55 wt % of Al for 5 hr and 168 hr (7 days), whereafter the change in the thicknesses of the sheets were compared. The results are shown in Table 1. Increase in sheet thickness (+) was due to increase of the alloy layer, while decrease in sheet thickness (−) was due to fusing loss. Nitriding was conducted in a salt bath.

TABLE 1

| Metal sheet | Change in sheet thickness after 5 hr ($\mu$m) | Change in sheet thickness after 168 hr ($\mu$m) |
|---|---|---|
| Ordinary steel (SS41) | Over −100 | — |
| Same, nitrided | 0 | Over −200 |
| Silicon steel (3% Si) | Over −100 | — |
| Same, nitrided | 0 | Over −200 |
| Structural steel (SCM4) | Over +100 | — |
| Same, nitrided | −10 | — |
| Stainless steel (SUS316) | −20 | +80 |
| Same, nitrided* | 0 | +50 |
| Stainless steel (SUS316L) | — | +90 |
| Same, nitrided* | — | −90 |
| Stainless steel (SUS304) | — | +120 |
| Same, nitrided* | — | −190 |
| Stainless steel (SUS430) | — | Over −200 |
| Same, nitrided* | — | +40 |
| (Titanium nitride/ceramic) | 0 | — |

Remarks:
1) The asterisks (*) indicate sheets that are examples of the invention. The chemical compositions of the stainless steels indicated in Table 1 are shown in Table 2.

TABLE 2

Chemical compositions of hot-rolled stainless steels

| Type symbol | Chemical composition (%) C | Si | Mn | P | S | Ni | Cr | Mo | Cu | Other | Remark |
|---|---|---|---|---|---|---|---|---|---|---|---|
| SUS304 | ≦0.08 | ≦1.00 | ≦2.00 | ≦0.040 | ≦0.030 | 8.00–10.50 | 18.00–20.00 | — | — | — | Austenitic |

TABLE 2-continued

Chemical compositions of hot-rolled stainless steels

| Type | Chemical composition (%) | | | | | | | | | | |
|---|---|---|---|---|---|---|---|---|---|---|---|
| symbol | C | Si | Mn | P | S | Ni | Cr | Mo | Cu | Other | Remark |
| SUS316 | ≦0.08 | " | " | " | " | 10.00–14.00 | 16.00–18.00 | 2.00–3.00 | — | — | |
| SUS316L | ≦0.030 | " | " | " | " | 12.00–15.00 | 16.00–18.00 | 2.00–3.00 | — | — | |
| SUS430 | ≦0.12 | ≦0.75 | ≦1.00 | " | " | ≦0.60 | 16.00–18.00 | — | — | — | Ferritic |

The invention adopts stainless steel as the base metal because, as can be seen from Table 1, the steel itself is relatively stable and becomes even stabler when nitrided. SUS316 and SUS316L are outstanding at least in sheet thickness change. The titanium nitride (ceramic) was extremely stable.

Further, a SUS316 test sheet was heated to 800° C. and held in a stream of gas composed of 95% of nitrogen and 5% of ammonia for 30 min. The test sheet was then immersed for 5 hr in a 600° C. hot dip galvanizing bath containing 55 wt % of Al. No change was observed in its appearance and its thickness also remained unchanged.

Nitriding is conducted by a known method such as by use of a hot bath composed primarily of, for example, a cyanide, a cyanate and a carbonate, or by a method using a gas containing nitrogen gas, ammonia gas or the like. Nitriding in a hot (molten) salt is conducted by immersing the member in a hot salt bath composed mainly of, for example, potassium cyanide, potassium cyanate and sodium carbonate at 500–600° C. for 10 min to 3 hr. The hot salt bath may contain some amount of yellow prussiate of potash.

Usable cyanides include potassium cyanide, sodium cyanide and the like, usable cyanates include potassium cyanate, sodium cyanate and the like, and usable carbonates include potassium carbonate, sodium carbonate and the like. Sodium chloride, potassium chloride and the like can be used in place of the carbonate.

Nitriding in ammonia gas is conducted at a temperature of 500–525° C. and a gas pressure of 50–80 mmHg for one to several days. Otherwise it is conducted in nitrogen and/or ammonia gas at a pressure of 1–10 kg/cm$^2$ and a temperature of 800–1400° C. for several hours.

In other words, ammonia gas and/or nitrogen gas are used as the nitrogen source and are held at a temperature of about 500–1400° C. Introduction of hydrogen gas for suppressing oxidation of the member or of argon gas, helium gas or other totally inert gas causes no problem.

What is required is the formation, at the outermost surface of the member, of nitrides of elements composing the stainless steel and formation thereunder (internally) of a nitrogen-diffused layer. The invention does not particular specify the nitriding method and can use either the salt bath method or the gas method.

The term "stainless steel" as used regarding the invention is defined as a Cr stainless steel or a Cr—Ni stainless steel, more specifically, as an alloy steel having a Cr content of not less than 12%. It is well known that these steels also contain Mo, W, V and the like in addition to Cr and Ni.

This invention can achieve its object simply by nitriding a member finished to the prescribed shape in a hot dip galvanizing bath. The production process is highly advantageous since the member can be fabricated with substantially no need for attention to change in shape, change in dimensions, or change in surface roughness caused by the nitriding treatment.

The invention can be applied to any member that comes in contact with the hot dip galvanizing bath including, but not limited to, such typical examples as support rolls, sinker rolls, bearings for either of these, and pots.

EXAMPLE 1

Figure 2:
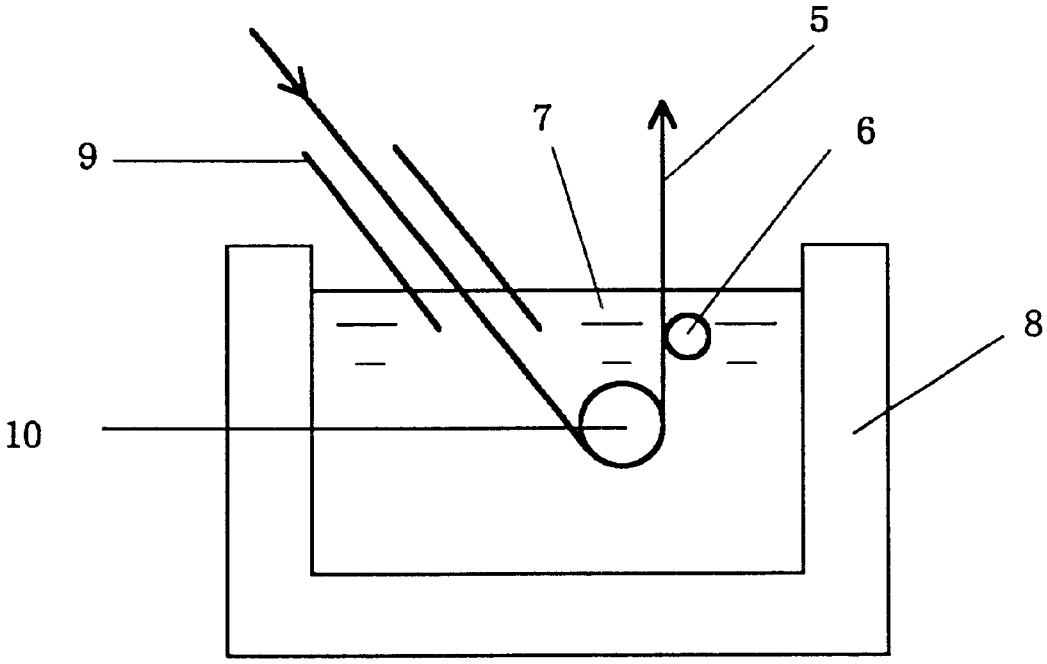
FIG. 2 is a sectional view showing the hot dip galvanizing bath section of a hot dip galvanized steel sheet production line.

A support roll for use in continuous hot dip galvanizing measuring 1500 mm in length and 300 mm in diameter was fabricated using SUS316 as the starting material. (As shown in FIG. 2, a support roll is one of the members of the hot dip galvanizing bath section of a hot dip galvanized steel sheet production line.) The support roll was treated in a molten mixed salt bath of 15 wt % of potassium cyanide, 15 wt % of potassium cyanate and 70 wt % of sodium carbonate at 580° C. for 90 min.

The treated support roll was cooled in air and washed with water. It was then installed as the support roll 6 of the hot dip galvanizing bath 7 shown in FIG. 2. The hot dip galvanizing bath was composed of 0.2 wt % of Al, 0.1 wt % of Fe and the balance of Zn. The temperature of the hot dip galvanizing bath in operating condition was 500° C.

In FIG. 2, 5 is steel sheet, 8 is a pot, 9 is a snout and 10 is a sinker roll.

The support roll was found to overcome major problems of the conventional support roll, namely, that of degradation and peeling occurring within 6 to 12 months of immersion owing to reaction of the flame-sprayed coating containing nickel and/or cobalt with molten-state zinc and that of adhesion to the roll of a three-element alloy of iron, aluminum and zinc. As such, it also greatly reduced occurrence of defects in the surface of the hot dip galvanized steel sheet.

Since the support roll did not require the previously indispensable preheating or uniform heating before immersion in the hot dip galvanizing bath, it immensely simplified the work of exchanging rolls.

EXAMPLE 2

The Al content of the hot dip galvanizing bath of Example 1 was changed to 4 wt %. The same effects were obtained as in Example 1.

EXAMPLE 3

The Al content of the hot dip galvanizing bath of Example 1 was changed to 53 wt %. Analysis of the hot dip galvanizing bath at the operating temperature of 600° C. showed it to contain Si, Fe etc. in addition to 53 wt % of Al and 43.4 wt % of Zn.

The support roll was found to eliminate the phenomenon arising in the conventional support roll of a three-element alloy of iron, aluminum and zinc adhering to the roll owing to reaction of the flame-sprayed coating containing nickel and/or cobalt with the molten-state zinc. As such, it overcame such problems as marring of the steel sheet, greatly reducing occurrence of defects in the surface of the hot dip galvanized steel sheet.

Since the support roll did not require preheating or uniform heating before immersion in the hot dip galvanizing bath, it immensely simplified the work of exchanging rolls.

Since, as explained in the foregoing, the member for immersion in a hot dip galvanizing bath according to the invention uses stainless steel as its base metal and has the nitrided layer and the nitrogen-diffused layer, it exhibits excellent erosion resistance in a hot dip galvanizing bath and does not require the preheating or the like necessary in the case of a flame-sprayed member. In addition, it is easy to produce.

What is claimed is:

1. A hot dip galvanizing bath apparatus having a component comprising a sinker roll, a support roll or bearing and wherein said component having a nitrided layer and a nitrogen diffused layer on the surface obtained by nitriding it in a salt bath containing a cyanide, a cyanate and a carbonate and/or by heat-treating it in an atmosphere containing ammonia and/or nitrogen.

2. A method of using a roll or bearing as an immersion member component in a hot dip galvanizing bath apparatus wherein said roll or bearing has a nitrided layer and a nitrogen diffused layer on the surface.

3. A process for producing a member for immersion in a hot dip galvanizing bath which contains aluminum, comprising a step of fabricating a member for immersion in a hot dip galvanizing bath which contains aluminum, said member comprising a sinker roll, a support roll or a bearing of stainless steel as a base metal and a step of forming a nitride layer and a nitrogen-diffused layer on the surface of the member by nitriding it in a salt bath containing a cyanide, a cyanate and a carbonate and/or by heat-treating it in an atmosphere containing ammonium and/or nitrogen.

4. A process for producing a hot dip galvanizing bath apparatus including a roll or bearing as an immersion member component in a hot dip galvanizing bath which contains aluminum, wherein a roll or bearing has formed thereon a nitrided layer and a nitrogen diffused layer on the surface thereof by nitriding it in a salt bath containing a cyanide, a cyanate and a carbonate and/or by heat-treating it in an atmosphere containing ammonia and/or nitrogen.

* * * * *